United States Patent [19]

Gibson

[11] 4,327,852

[45] May 4, 1982

[54] BACKPACK HARNESS

[76] Inventor: Harvey P. Gibson, 11514 Hillside La., Mequon, Wis. 53209

[21] Appl. No.: 180,458

[22] Filed: Aug. 22, 1980

[51] Int. Cl.[3] ..... A45F 3/00

[52] U.S. Cl. ..... 224/214; 224/209

[58] Field of Search ..... 224/260, 215, 250, 259, 224/214, 209

[56] References Cited

U.S. PATENT DOCUMENTS

| | | | |
|---|---|---|---|
| 157,537 | 12/1874 | Palmer | 224/209 X |
| 268,932 | 12/1882 | Poirier | 224/209 X |
| 707,610 | 8/1902 | Moeller | 224/214 X |
| 995,963 | 6/1911 | Harriman | 224/214 |
| 1,178,628 | 4/1916 | Clawson | 224/209 X |
| 1,217,262 | 2/1917 | Abercrombie | 224/214 X |
| 1,879,480 | 9/1932 | Pures | 224/209 X |
| 3,258,182 | 6/1966 | McDonald | 224/209 X |
| 3,346,154 | 10/1967 | Bishop | 224/209 X |

FOREIGN PATENT DOCUMENTS

| | | | |
|---|---|---|---|
| 881174 | 4/1943 | France | 224/215 |
| 14452 | 3/1905 | Norway . | |
| 190880 | 1/1923 | United Kingdom . | |

*Primary Examiner*—Steven M. Pollard

*Attorney, Agent, or Firm*—James L. Bean

[57] ABSTRACT

A lightweight, flexible backpacking harness includes a pair of elongated shoulder straps crossed and permanently joined intermediate their ends and having their end portions adapted to be releasably and adjustably joined to one another. In use, the crossed permanently joined portions of the shoulder straps are positioned on the wearer's back and one end portion of the joined straps extend one over each shoulder and the other end portions extend one around each side of the body from back to front in position to be releasably and adjustably joined to the strap portion extending over the shoulder on the corresponding side of the wearer. An adjustable chest strap releasably connects the joined end portions of the shoulder straps, and a plurality of pair of elongated flexible ties or straps are permanently joined to the two shoulder straps in the area thereof extending over the wearer's back to enable articles to be secured on the harness for carrying.

9 Claims, 3 Drawing Figures

BACKPACK HARNESS

BACKGROUND OF THE INVENTION

1. Field of the Invention

This invention relates to a load carrying harness and more particularly to an improved compact, lightweight, flexible harness useful as a backpacking harness for carrying irregularly shaped articles on a person's back.

2. Description of the Prior Art

The use of backpacking harness has become increasingly popular in recent years, and elaborate equipment has been developed for various uses ranging from the carrying of books by students to camping equipment and supplies by outdoorsman. Such equipment generally has included a rigid frame structure supported on the back by a system of straps extending over the shoulder and around the body of the wearer, with a canvas cover supported on the frame to provide pockets, ties, and the like for containing and carrying articles. It is also known to provide lightweight backpack pouches or knapsacks supported on the back by shoulder straps. Such equipment, however, is relatively bulky, even when formed from the lightweight, high strength synthetic fabric materials now available so that, when empty, the device cannot comfortably be worned under outer clothing or conveniently carried in the pocket. Further, the lightweight knapsack type equipment generally available does not provide for carrying relatively large, irreguarly shaped articles.

Carrying harness is also known which includes flexible shoulder straps employed in combination with a waist-encircleing belt or strap to distribute weight between the shoulders and hips. One such device is illustrated, for example, in U.S. Pat. No. 707,610 which teaches the use of flexible load supporting straps on the belt for carrying loads such as stretchers, with a portion of the load being carried by shoulder straps attached to the belt at points adjacent the load supporting straps.

While the prior art devices of the type described above have generally been useful for their intended purposes, there has remained a need for a compact, lightweight backpack harness for general purpose use in the carrying of relatively light, or irregularly shaped articles. For example, hunters, or hikers on a days outing may require heavy coats in early morning or late afternoon hours which are not needed during the warmer portion of the day. Carrying of such excess clothing, when not being worn, interferes with the free use of a person's hands and it would be convenient to have a means for carrying such articles when needed and which would not interfere with the persons movement or activity when not in use. Accordingly, it is the primary object to the present invention to provide an improved, lightweight, flexible and compact backpack harness.

Another object of the invention is to provide such an improved backpack harness which may be comfortably worn under a coat or jacket when not in use to carry a load, or alternatively can be removed and easily carried in a pocket.

Another object is to provide such an improved backpack harness having means for attaching articles of various shapes thereto for support on the wearers back.

BRIEF DESCRIPTION OF THE DRAWINGS

The foregoing and other objects and advantages of the present invention will be apparent from the detailed description contained herein below, taken in conjunction with the drawings, in which.

DESCRIPTION OF THE PREFERRED EMBODIMENT

Figure 1:
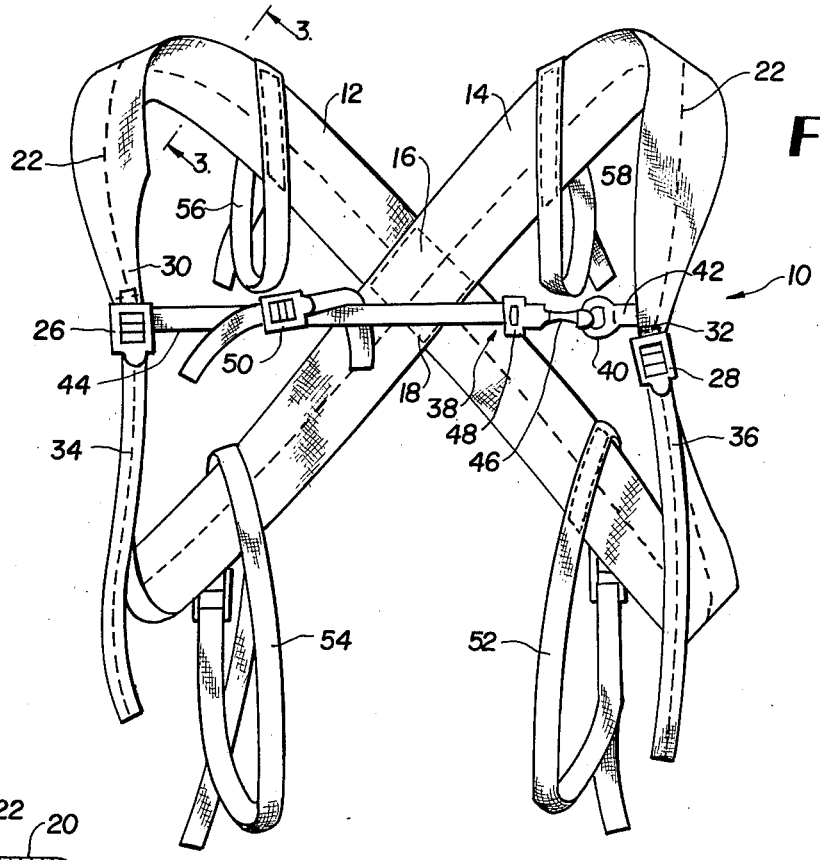
FIG. 1 is a front elevation view of the backpack harness according to the present invention shown in the shape taken by the harness when being worn by a person.

Referring now to the drawings in detail, the improved backpack harness according to the present invention is designated generally by the reference numeral 10 and includes a pair of substantially identical main load carrying straps, or shoulder straps, 12, 14 arranged in crossed relation and permanently joined to one another in a rectangular area 16 as by stitching illustrated by the broken line at 18. Straps 12 and 14 each include a central portion which is relatively wide, preferably 2 to 3 inches wide at least in the area which extends over the wearer's shoulders with the ends of the respective straps being substantially more narrow as illustrated most clearly in FIG. 1. The shoulder straps 12, 14 are preferably each formed from an elongated strip 20 of lightweight, high-strength material, preferably a synthetic fabric material such as nylon, rayon, polyester, or the like, with the strip 20 having its edges folded over and joined by a longitudinally extending line of stitching 22 extending completely through the folded material to form a flat strap. The end portions of the fabric strip 20 may be double-folded so that the more narrow end portions of shoulder straps 12, 14 contain the same fabric, and therefore are of the same strength, as the wider central portions. However, due to the additional folding, the narrow end portions will be slightly stiffer and therefore more easily managed for purpose of joining with buckles as described below. Alternatively, one or both narrow end portions may be in the form of a separate length of material such as a flexible webbing attached to the ends of the folded fabric strip, as by stitching, or the entire straps may be formed from one or more lengths of woven belt material.

Figure 3:
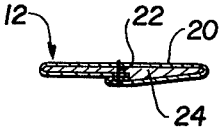
FIG. 3 is a sectional view, on an enlarged scale, taken on line 3–3 of FIG. 1.

As illustrated in FIG. 3, the relatively wide central portion of shoulder straps may contain a layer 24 of filler material folded inside the fabric and joined with the line of stitching. The filler material 24 is preferably a relatively thin webbing or matt of material having sufficient dimensional stability to assist in maintaining the straps in the relatively flat configuration and to assist in resisting rolling or folding. When such filler material is used, it is preferably confined to the upper end portions of the shoulder straps 12, 14 in the area which extends over the shoulder of a wearer in order to maintain the overall weight of the harness to a minimum.

Suitable fastener means such as the strap buckles 26 and 28 are provided to join the ends of straps 12, 14 to one another at the front of a person wearing the harness. Buckles 26 28 are preferably permanently joined one to one end of each strap, for example the upper end of the strap extending over the shoulder. This may be accomplished by threading the reduced width upper end portions 30, 32 respectively of straps 12, 14 through buckles 26, 28, respectively then folding the reduced end portions back on themselves and joining the folded ends to the straps by stitching.

The lower, narrow end portions 34, 36 of straps 12, 14, respectively are relatively long to enable adjustment of the harness on a wearer of any size to provide a comfortable fit. When the harness is being worn, the lower end 36 of strap 14 is attached to buckle 26 on the upper end 30 of strap 12, and the lower end 34 of strap 12 is attached to the buckle 28 on the upper end 32 of strap 14. To secure the harness in position on a wearer, an adjustable, flexible chest strap 38 is provided to releasably connect the upper end portions of straps 12, 14, in the area of buckles 26, 28. Chest strap 38 may include a rigid eye 40 attached by a short length of webbing to the end portion of shoulder strap 14 as illustrated in FIG. 1, and a second length of webbing 44 attached to shoulder strap 12 adjacent buckle 26. The length of webbing extends across the chest of the wearer and has a releasable hook or clasp 46 mounted on its end in position to releasably engage the eye 40. Releasable clasp 46 may have a strap buckle portion 48 integrally formed on its end for adjustably receiving the webbing 44. In an alternative arrangement, the length of webbing 44 may be in two sections, one connected to clasp 46 and the other connected to the end portion 32 of shoulder strap 14, with a simple strap buckle 50 provided to adjustably join the two sections. In a further alternative embodiment, the clasp and eye may be eliminated, and the strap 38 can comprise two length of webbing joined one to each shoulder strap and connected together by the buckle 50.

Figure 2:
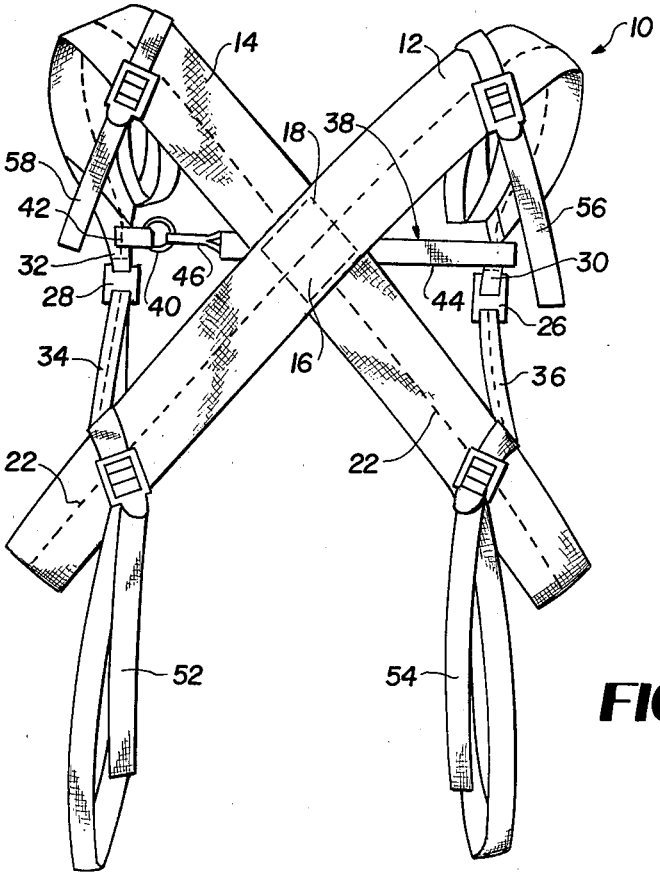
FIG. 2 is a rear elevation view of the harness shown in FIG. 1.

In order to secure loads to be carried on the harness, a plurality of elongated, flexible belts or ties are permanently joined to the shoulder straps 12, 14, in the area thereof extending along a wearer's back. In FIGS. 1 and 2, four such ties 52, 54, 56 and 58 are shown with ties 52 and 54 being attached one to each shoulder straps 12, 14 at corresponding positions below joint 16 and ties 56, 58 joined one to each of straps 12 and 14 at corresponding points above joint 16. Preferably the load attaching ties are each formed of a relatively thin, high strength flexible fabric webbing or the like secured as by stitching directly to the shoulder straps at a point intermediate the ends of the ties with suitable means such as a strap buckle 40 being provided for each tie to enable rapid and easy attachment and release of a load of irregular shape such as a rolled jacket, camping equipment, or the like to the harness. It should be understood, also, that any number of such attaching ties can be employed and that the location of such ties can be changed as desired.

By constructing the harness of a lightweight, high strength flexible material, it is believed apparent that it can be comfortably worn, when not employed to carry a load, without in any way interfering with movement of the wearer. Further, the harness can be worn either over or under outer clothing such as hunting jackets or the like so as to be readily available for use. Alternatively, the lightweight fabric material can readily be folded so that the entire harness can easily be carried in a pocket.

While I have disclosed and described a preferred embodiment of my invention, I wish it understood that I do not intend to be restricted solely thereto, but rather that I do intend to include all embodiments thereof which would be apparent to one skilled in the art in which come within the spirit and scope of my invention.

I claim:

1. A lightweight flexible compact backpacking harness capable of being worn under conventional outer coats or folded and carried in a pocket when not in use, the harness comprising, in combination, a pair of elongated flexible shoulder straps crossed and permanently joined together at a fixed point intermediate their ends with the fixed point being in an area to be disposed on the back of a person wearing the harness, said shoulder straps having upper end portions extending in an upwardly diverging relation from the fixed point to extend one over each shoulder from the back to the chest of a person wearing the harness and lower end portions extending in a downwardly diverging relation from the fixed point to extend one around each side and upwardly in front of the person, fastener means on one end portion of each shoulder strap for securing the lower end of each shoulder strap to the upper end of the other shoulder strap in the area of the chest of a person wearing the harness, chest strap means adapted to extend across the chest of a person wearing the harness to releasably join the shoulder strap, and a plurality of elongated flexible tie members separately and permanently attached intermediate their ends to each of said shoulder straps, said tie members each being positioned and adapted to secure articles to be carried on the back of a person wearing the harness.

2. The backpack harness as defined in claim 1, wherein said shoulder straps are each formed from an elongated strip of fabric folded upon itself and joined together to form an elongated strap.

3. The backpack harness as defined in claim 2, further comprising filler material folded within said strips of fabric material and joined into said straps at least in the area extending over the shoulder of a person wearing the harness.

4. The backpack harness as defined in claim 3, wherein said shoulder straps each include a central portion having a first predetermined width and at least one end portion of a width substantially less than that of the central portion.

5. The invention as defined in claim 4, wherein said chest strap means includes length adjusting means and wherein said fastener means is adjustable to adjust the position at which said end portions of said shoulder straps are secured to one another whereby the harness may be adjusted to fit persons of different sizes.

6. The backpack harness as defined in claim 1 wherein said shoulder straps each include a central portion having a first predetermined width and at least one end portion of a width substantially less than that of the central portion.

7. The invention as defined in claim 6, wherein said chest strap means includes length adjusting means and wherein said fastener means is adjustable to adjust the position at which said end portions of said shoulder straps are secured to one another whereby the harness may be adjusted to fit persons of different sizes.

8. The backpack harness as defined in claim 1, wherein said shoulder straps each comprise a length of woven belt material.

9. The invention as defined in claim 8, wherein said chest strap means includes length adjusting means and wherein said fastener means is adjustable to adjust the position at which said end portions of said shoulder straps are secured to one another whereby the harness may be adjusted to fit persons of different sizes.

* * * * *